US009661437B2

(12) United States Patent
Nakano

(10) Patent No.: US 9,661,437 B2
(45) Date of Patent: May 23, 2017

(54) SIGNAL PROCESSING APPARATUS, SIGNAL PROCESSING METHOD, AND PROGRAM

(75) Inventor: Kenji Nakano, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 449 days.

(21) Appl. No.: 13/069,233

(22) Filed: Mar. 22, 2011

(65) Prior Publication Data

US 2011/0243336 A1 Oct. 6, 2011

(30) Foreign Application Priority Data

Mar. 31, 2010 (JP) ..... P2010-080517

(51) Int. Cl.

| | |
|---|---|
| ***H04R 5/00*** | (2006.01) |
| ***H04R 5/02*** | (2006.01) |
| ***H04S 7/00*** | (2006.01) |
| ***H04S 1/00*** | (2006.01) |
| ***H04S 3/00*** | (2006.01) |
| ***H04S 5/00*** | (2006.01) |

(52) U.S. Cl.

CPC ..... *H04S 7/30* (2013.01); *H04S 1/002* (2013.01); *H04S 1/005* (2013.01); *H04S 3/00* (2013.01); *H04S 5/00* (2013.01); *H04R 5/02* (2013.01); *H04R 2420/03* (2013.01); *H04R 2499/13* (2013.01); *H04S 2400/01* (2013.01); *H04S 2400/11* (2013.01); *H04S 2420/01* (2013.01); *H04S 2420/07* (2013.01)

(58) Field of Classification Search

CPC . H04S 5/00; H04S 5/005; H04S 1/002; H04S 2420/01; H04S 1/005; H04S 3/00; H04S 2400/01; H04S 7/30; H04S 2400/11; H04S 2420/07; H04R 5/00; H04R 5/02; H04R 2499/13; H04R 2420/03

USPC ..... 381/17, 307, 310

See application file for complete search history.

(56) References Cited

U.S. PATENT DOCUMENTS

| | | | | |
|---|---|---|---|---|
| 3,952,157 | A * | 4/1976 | Takahashi et al. | 381/22 |
| 4,188,504 | A * | 2/1980 | Kasuga et al. | 381/17 |
| 5,657,391 | A * | 8/1997 | Jyosako | 381/1 |

(Continued)

FOREIGN PATENT DOCUMENTS

| | | |
|---|---|---|
| CN | 101350931 A | 1/2009 |
| JP | 07-319487 | 12/1995 |

(Continued)

OTHER PUBLICATIONS

Office Action issued by Japanese Patent Office in counterpart Application No. 2010-080517 mailed Feb. 20, 2014, and English translation thereof.

(Continued)

*Primary Examiner* — Duc Nguyen
*Assistant Examiner* — Sean H Nguyen
(74) *Attorney, Agent, or Firm* — Chip Law Group

(57) ABSTRACT

A signal processing apparatus includes: an audio image localization processing unit performing audio image localization processing on a sound signal of each frequency band for each channel of the sound signal based on information used to determine an audio image localization position of each frequency band; and a mixing unit mixing the sound signals of the respective channels subjected to the audio image localization processing by the audio image localization processing unit.

8 Claims, 8 Drawing Sheets

(56) References Cited

U.S. PATENT DOCUMENTS

| | | | | |
|---|---|---|---|---|
| 5,796,843 | A * | 8/1998 | Inanaga | H04S 3/004 381/17 |
| 5,959,597 | A * | 9/1999 | Yamada et al. | 345/8 |
| 6,026,169 | A * | 2/2000 | Fujimori | 381/61 |
| 6,122,382 | A * | 9/2000 | Iida et al. | 381/18 |
| 6,222,930 | B1 * | 4/2001 | Nakano et al. | 381/307 |
| 6,343,131 | B1 * | 1/2002 | Huopaniemi | 381/310 |
| 6,763,115 | B1 | 7/2004 | Kobayashi | |
| 6,941,333 | B2 * | 9/2005 | Akune et al. | 708/313 |
| 7,072,474 | B2 * | 7/2006 | Nelson et al. | 381/17 |
| 2002/0034308 | A1 * | 3/2002 | Usui et al. | 381/17 |
| 2005/0195092 | A1 * | 9/2005 | Takahashi et al. | 340/692 |
| 2006/0013419 | A1 * | 1/2006 | Ko et al. | 381/310 |
| 2006/0045275 | A1 * | 3/2006 | Daniel | G10H 1/0091 381/17 |
| 2006/0045295 | A1 * | 3/2006 | Kim | 381/310 |
| 2007/0154020 | A1 * | 7/2007 | Katayama | 381/17 |
| 2007/0230724 | A1 * | 10/2007 | Konagai | H04R 3/12 381/303 |
| 2007/0291949 | A1 * | 12/2007 | Imaki | 381/17 |
| 2008/0181418 | A1 * | 7/2008 | Kim et al. | 381/17 |
| 2008/0187156 | A1 * | 8/2008 | Yokota | 381/307 |
| 2008/0219454 | A1 * | 9/2008 | Iida et al. | 381/17 |
| 2008/0260174 | A1 * | 10/2008 | Yokota | G10K 11/178 381/71.4 |
| 2009/0110212 | A1 * | 4/2009 | Iwasaki | 381/92 |
| 2009/0180625 | A1 * | 7/2009 | Bai et al. | 381/17 |
| 2009/0208022 | A1 * | 8/2009 | Fukui et al. | 381/17 |
| 2009/0214045 | A1 * | 8/2009 | Fukui et al. | 381/17 |
| 2010/0080396 | A1 * | 4/2010 | Aoyagi | 381/17 |
| 2010/0260483 | A1 * | 10/2010 | Strub | 386/97 |
| 2010/0266133 | A1 * | 10/2010 | Nakano | 381/17 |
| 2010/0272417 | A1 * | 10/2010 | Nagasawa et al. | 386/97 |
| 2010/0322428 | A1 * | 12/2010 | Fukui et al. | 381/17 |
| 2011/0164769 | A1 | 7/2011 | Zhan et al. | |

FOREIGN PATENT DOCUMENTS

| | | | | |
|---|---|---|---|---|
| JP | 09-093700 | | 4/1997 | |
| JP | 11-046400 | | 2/1999 | |
| JP | 2000-50400 | * | 2/2000 | H04S 1/00 |
| JP | 2000-111657 | | 4/2000 | |
| JP | 2007-158985 | | 6/2007 | |
| JP | 2009-278381 | | 11/2009 | |

OTHER PUBLICATIONS

Office Action issued by the State Intellectual Property Office of People's Republic of China in counterpart Application No. 2011-0077505.4 issued Jul. 3, 2014, and English translation thereof.

* cited by examiner

FIG. 5

| | FREQUENCY BAND 1 | FREQUENCY BAND 2 | • • • | FREQUENCY BAND n |
|---|---|---|---|---|
| LONG DISTANCE VIRTUAL AUDIO SOURCE POSITION W | 0.5 | 0 | • • • | 0.3 |
| REAL AUDIO SOURCE POSITION W | 0.2 | 1 | • • • | 0.5 |
| SHORT DISTANCE VIRTUAL AUDIO SOURCE POSITION W | 0.3 | 0 | • • • | 0.2 |

SIGNAL PROCESSING APPARATUS, SIGNAL PROCESSING METHOD, AND PROGRAM

BACKGROUND OF THE INVENTION

1. Field of the Invention

The present invention relates to a signal processing apparatus, a signal processing method, and a program, and more particularly, to a signal processing apparatus, a signal processing method, and a program capable of providing a sense of a sound field according to a sense of depth of a video.

2. Description of the Related Art

In the field of videos, there is a high possibility that a so-called stereoscopic video is widely used as household contents in the future. Therefore, it is anticipated that a sound accompanying a video has a sense of depth.

Depth information regarding each position of a video has been attempted to be extracted from difference information of right-eye and left-eye videos which are constituent elements of a stereoscopic video. Moreover, for example, meta-information used to give the depth information to contents is embedded by a content producer. Therefore, the depth information can be referred from information other than sound information (Japanese Unexamined Patent Application Publication No. 2000-50400).

At present, however, a sound accompanying such a video has a 5.1 ch or stereo format without changes from the related art. Moreover, in many cases, the sound field image basically has no relation to the depth or projection of a video. This is mainly because many contents have been produced for cinematic movies to show a movie to unspecified listeners. Therefore, in a present reproduction system, it is not easy to give a sense of depth to a sound (which accompanies a video, for example, a center sound), and consequently, reproduction speakers adjacent to each other are just combined at the positions for sound arrangement.

SUMMARY OF THE INVENTION

When such contents are reproduced at home, it is less necessary to allow many unspecified listeners to simultaneously view a movie. Therefore, it is considered that the unspecified listeners are more likely to be immersed into the movie if a stereoscopic video and a sound are blended with each other by a subsequent process of allowing the listeners to feel a sense of depth of the sound.

In such an environment, it is necessary to allow a sound accompanying a video to have a sense of depth at present.

In the light of the foregoing, it is desirable to provide a sense of a sound field according to a sense of depth of a video.

According to an embodiment of the invention, there is provided a signal processing apparatus including: audio image localization processing means for performing audio image localization processing on a sound signal of each frequency band for each channel of the sound signal based on information used to determine an audio image localization position of each frequency band; and mixing means for mixing the sound signals of the respective channels subjected to the audio image localization processing by the audio image localization processing means.

The information used to determine the audio image localization position may be information regarding a weight of a predetermined position for audio image localization.

The signal processing apparatus may further include storage means for storing the information used to determine the audio image localization position for each frequency band. The audio image localization processing means may perform the audio image localization processing on the sound signal of each frequency band for each channel of the sound signal based on the information used to determine the audio image localization position of each frequency band stored in the storage means.

The signal processing apparatus may further include extraction means for extracting the information used to determine the audio image localization position of each frequency band multiplexed in the sound signal. The audio image localization processing means may perform the audio image localization processing on the sound signal of each frequency band for each channel of the sound signal based on the information used to determine the audio image localization position of each frequency band extracted by the extraction means.

The signal processing apparatus may further include analysis means for analyzing the information used to determine the audio image localization position of each frequency band from parallax information in an image signal corresponding to the sound signal. The audio image localization processing means may perform the audio image localization processing on the sound signal of each frequency band for each channel of the sound signal based on the information used to determine the audio image localization position of each frequency band analyzed by the analysis means.

According to another embodiment of the invention, there is provided a signal processing method of a signal processing apparatus including audio image localization processing means and mixing means. The signal processing method may include the steps of: performing, by the audio image localization processing means, audio image localization processing on a sound signal of each frequency band for each channel of the sound signal based on information used to determine an audio image localization position of each frequency band; and mixing, by the mixing means, the sound signals of the respective channels subjected to the audio image localization processing by the audio image localization processing means.

According to still another embodiment of the invention, there is provided a program causing a computer to function as: audio image localization processing means for performing audio image localization processing on a sound signal of each frequency band for each channel of the sound signal based on information used to determine an audio image localization position of each frequency band; and mixing means for mixing the sound signals of the respective channels subjected to the audio image localization processing by the audio image localization processing means.

According to still another embodiment of the invention, audio image localization processing is performed on a sound signal of each frequency band for each channel of the sound signal based on information used to determine an audio image localization position of each frequency band, and the sound signals of the respective channels subjected to the audio image localization processing by the audio image localization processing unit are mixed to each other.

The above-described signal processing apparatus may be an independent apparatus or may be an internal block of one signal processing apparatus.

According to the embodiments of the invention, a sense of the sound field can be provided according to a sense of depth of a video.

BRIEF DESCRIPTION OF THE DRAWINGS

FIG. 5 is a diagram illustrating an example of depth control information.

DESCRIPTION OF THE PREFERRED EMBODIMENTS

Hereinafter, embodiments of the invention will be described with reference to the drawings.

Exemplary Configuration of Signal Processing Apparatus

Figure 1:
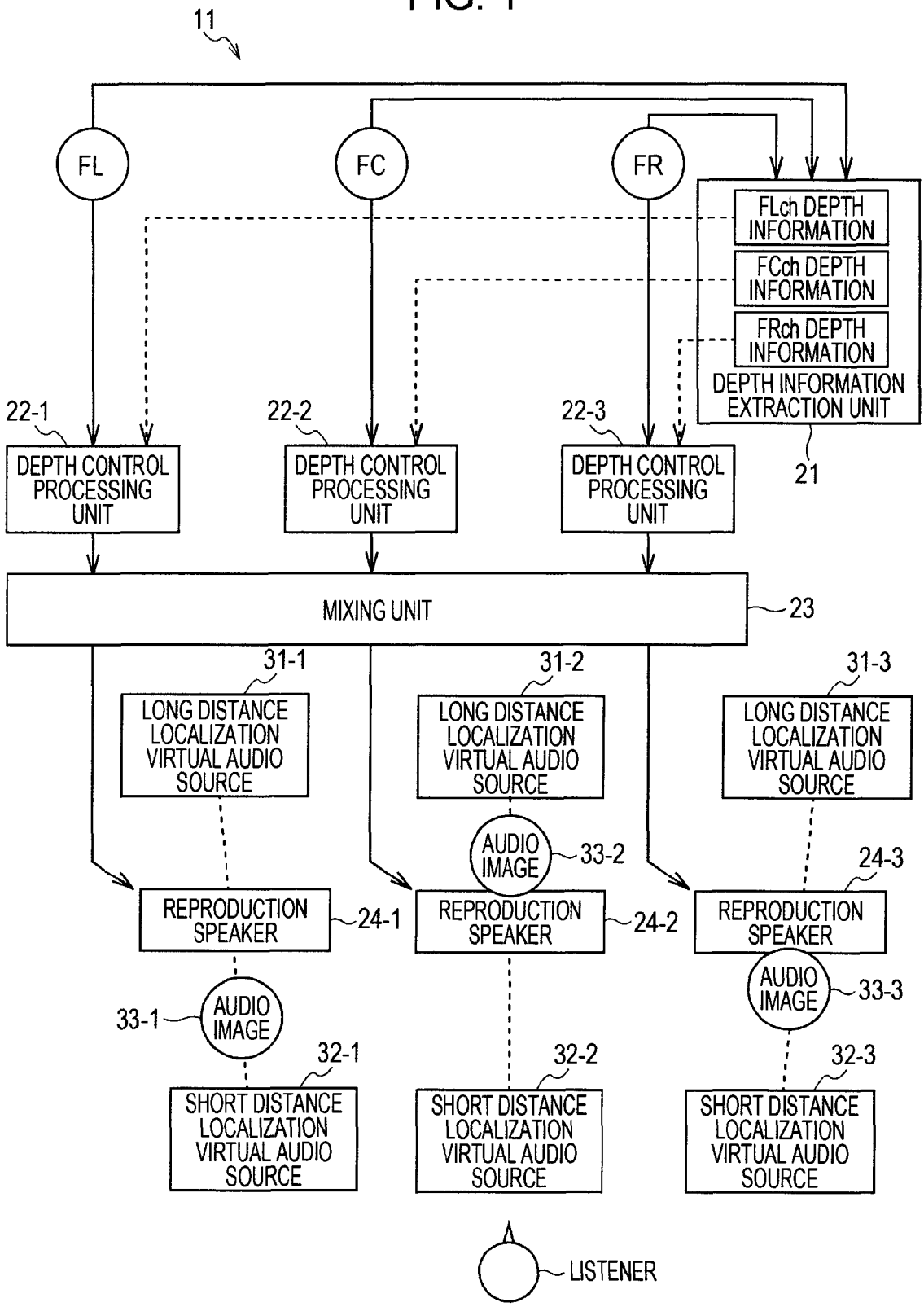
FIG. 1 is a block diagram illustrating the configuration of a signal processing apparatus according to a first embodiment of the invention.

FIG. 1 is a diagram illustrating the configuration of a signal processing apparatus according to a first embodiment of the invention.

A signal processing apparatus 11 in FIG. 1 performs depth control processing by an audio image synthesizing method by mixing a fixed position short distance localization virtual audio source and a fixed position long distance virtual audio source with a real audio source, for example, for each channel of FL, FR, FC among 5.1 ch (channel). The depth control processing is a process of localizing an audio image so as to get close (short distance localization) to a listener or localizing au audio image so as to get distant (long distance localization) from the listener with reference to the position of a real audio source (reproduction speaker).

The signal processing apparatus 11 includes a depth information extraction unit 21, depth control processing units 22-1 to 22-3, a mixing (Mix) unit 23, and reproduction speakers 24-1 to 24-3.

FLch, FCch, and FRch sound signals from a front stage (not shown) are input to the depth information extraction unit 21 and the depth control processing units 22-1 to 22-3, respectively.

The depth information extraction unit 21 extracts the respective FLch, FCch, FRch depth information multiplexed in advance by a content producer from the FLch, FCch, and FRch sound signals, respectively, and supplies the FLch, FCch, FRch depth information to the depth control processing units 22-1 to 22-3, respectively.

The depth control processing unit 22-1 performs depth control processing on the FLch sound signal based on the FLch depth information from the depth information extraction unit 21. The depth control processing unit 22-1 outputs an FL speaker output sound signal, an FC speaker output sound signal, and an FR speaker output sound signal of the depth control processing result for the FLch sound signal to the mixing unit 23.

The depth control processing unit 22-2 performs depth control processing on the FCch sound signal based on the FCch depth information from the depth information extraction unit 21. The depth control processing unit 22-2 outputs an FL speaker output sound signal, an FC speaker output sound signal, and an FR speaker output sound signal of the depth control processing result for the FCch sound signal to the mixing unit 23.

The depth control processing unit 22-3 performs depth control processing on the FRch sound signal based on the FRch depth information from the depth information extraction unit 21. The depth control processing unit 22-3 outputs an FL speaker output sound signal, an FC speaker output sound signal, and an FR speaker output sound signal of the depth control processing result for the FRch sound signal to the mixing unit 23.

The mixing unit 23 mixes the respective speaker output sound signals from the depth control processing units 22-1 to 22-3 for each speaker and outputs the mixed speaker output sound signals to the reproduction speakers 24-1 to 24-3, respectively.

The reproduction speaker 24-1 outputs a sound corresponding to the FL speaker output sound signal from the mixing unit 23. The reproduction speaker 24-2 outputs a sound corresponding to the FC speaker output sound signal from the mixing unit 23. The reproduction speaker 24-3 outputs a sound corresponding to the FR speaker output sound signal from the mixing unit 23.

Here, as for the audio image synthesizing method, in a case of FLch, by giving a predetermined level balance between three audio sources: a real audio source which is the reproduction speaker 24-1; an FL long distance localization virtual audio source 31-1; and an FL short distance localization virtual audio source 32-1, a synthesized audio image 33-1 is formed between these audio sources. In the example of FIG. 1, the synthesized audio image 33-1 is formed in the substantial center between the reproduction speaker 24-1 and the FL short distance localization virtual audio source 32-1.

In a case of FCch, by giving a predetermined level balance between three audio sources: a real audio source which is the reproduction speaker 24-2; an FC long distance localization virtual audio source 31-2; and an FC short distance localization virtual audio source 32-2, a synthesized audio image 33-2 is formed between these audio sources. In the example of FIG. 1, the synthesized audio image 33-2 is formed near the reproduction speaker 24-2 between the reproduction speaker 24-2 and the FC long distance localization virtual audio source 31-2.

In a case of FRch, by giving a predetermined level balance between three audio sources: a real audio source which is the reproduction speaker 24-3; an FR long distance localization virtual audio source 31-3; and an FR short distance localization virtual audio source 32-3, a synthesized audio image 33-3 is formed between these audio sources. In the example of FIG. 1, the synthesized audio image 33-3 is formed near the reproduction speaker 24-3 between the reproduction speaker 24-3 and the FR short distance localization virtual audio source 32-3.

In this way, the signal processing apparatus 11 performs the depth control processing so that the synthesized audio images 33-1 to 33-3 formed from the audio images described in the respective channels depth information and the reproduced sounds approximately match each other.

Exemplary Configuration of Depth Control Processing Unit

Figure 2:
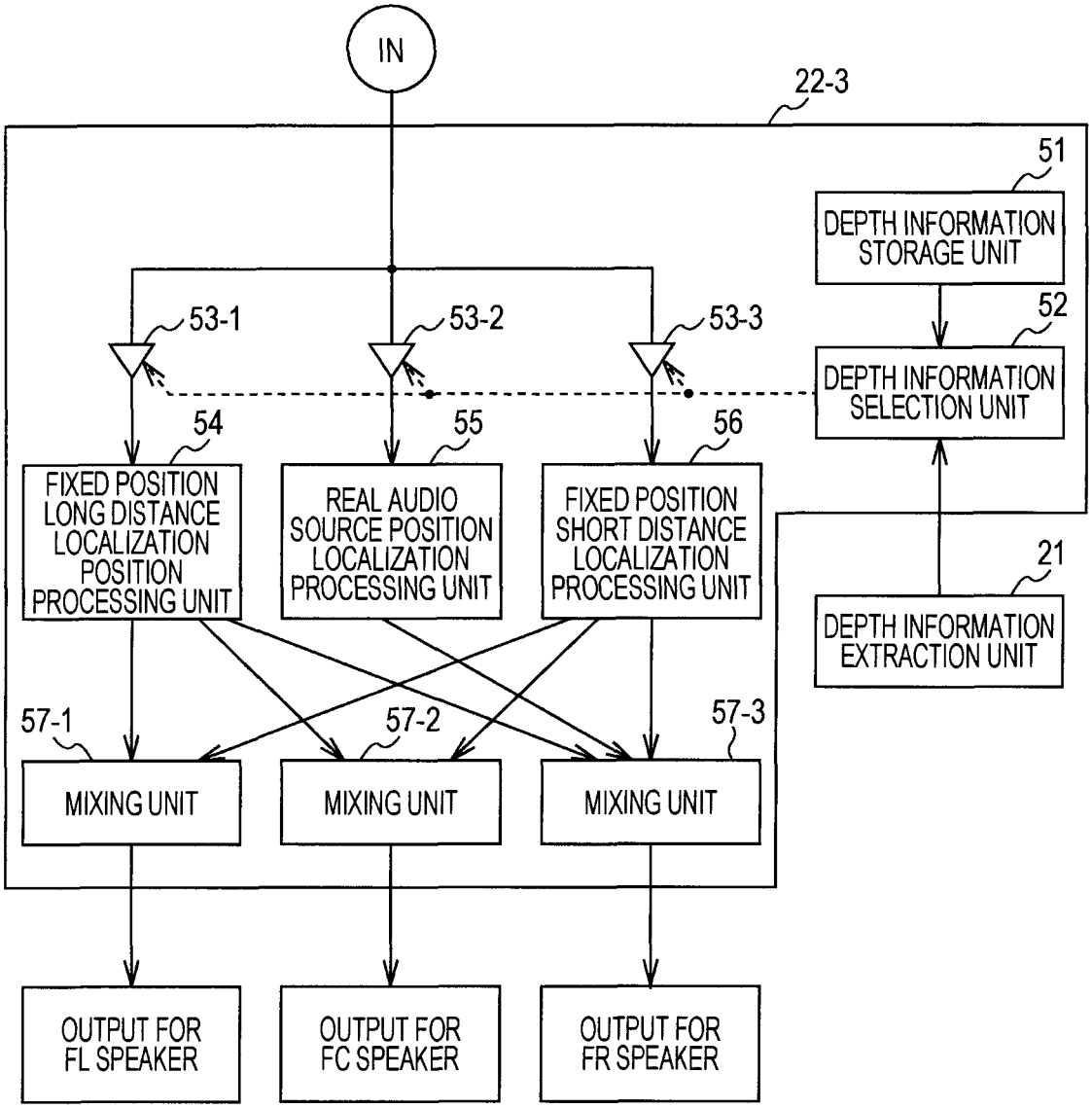
FIG. 2 is a block diagram illustrating an exemplary configuration of a depth control processing unit.

FIG. 2 is a block diagram illustrating an exemplary configuration of the depth control processing unit 22-3 performing the depth control processing on the FRch sound signal.

The depth control processing unit 22-3 includes a depth information storage unit 51, a depth information selection unit 52, attenuators 53-1 to 53-3, a fixed position long distance localization processing unit 54, a real audio source position localization processing unit 55, a fixed position short distance localization processing unit 56, and mixing units 57-1 to 57-3.

The depth information storage unit 51 stores the depth information regarding each audio source position in advance. The depth information selection unit 52 selects one of the depth information regarding each audio source position from the depth information extraction unit 21 and the depth information stored in advance. For example, the depth information selection unit 52 uses fixed depth information stored in advance when the depth information is not supplied from the depth information extraction unit 21, whereas the depth information selection unit 52 uses the supplied depth information when the depth information is supplied from the depth information extraction unit 21. Alternatively, the depth information may be selected by a setting of a user.

The depth information selection unit 52 supplies the selected depth information to the corresponding attenuators 53-1 to 53-3.

In the example of FIG. 2, the depth information describes attenuation amounts for the attenuators 53-1 to 53-3 (that is, each audio source position). Moreover, the depth information is not limited to the attenuation amount, but may describe a mixing ratio (Mix ratio) for the mixing units 57-1 to 57-3. In this case, the mixing units 57-1 to 57-3 perform mixing using the mixing ratio.

The attenuator 53-1 is an attenuator for long distance localization audio image position. The attenuator 53-1 attenuates the input FR sound signal based on the depth information from the depth information selection unit 52 and outputs the attenuated sound signal to the fixed position long distance localization processing unit 54. The attenuator 53-2 is an attenuator for real audio image position. The attenuator 53-2 attenuates the input FR sound signal based on the depth information from the depth information selection unit 52 and outputs the attenuated sound signal to the real audio source position localization processing unit 55. The attenuator 53-3 is an attenuator for short distance localization audio image position. The attenuator 53-3 attenuates the input FR sound signal based on the depth information from the depth information selection unit 52 and outputs the attenuated sound signal to the fixed position short distance localization processing unit 56.

The fixed position long distance localization processing unit 54 performs signal processing to form the FR long distance localization virtual audio source 31-3. The fixed position long distance localization processing unit 54 outputs the processed FL speaker output sound signal to the mixing unit 57-1, outputs the processed FC speaker output sound signal to the mixing unit 57-2, and outputs the processed FR speaker output sound signal to the mixing unit 57-3.

The real audio source position localization processing unit 55 performs signal processing to form the real audio source which is the reproduction speaker 24-3. The real audio source position localization processing unit 55 outputs the processed FR speaker output sound signal to the mixing unit 57-3.

The fixed position short distance localization processing unit 56 performs signal processing to form the FR short distance localization virtual audio source 32-3. The fixed position short distance localization processing unit 56 outputs the processed FL speaker output sound signal to the mixing unit 57-1, outputs the processed FC speaker output sound signal to the mixing unit 57-2, and outputs the processed FR speaker output sound signal to the mixing unit 57-3.

Since the real audio source localization processing unit 55 processes the real audio source as a processing target, only the FR speaker sound signal corresponding to the input FR sound signal is generated. Conversely, in the fixed position long distance localization processing unit 54 or the fixed position short distance localization processing unit 56, in order to form the FR long distance localization virtual audio source 31-3 or the FR short distance localization virtual audio source 32-3, it is necessary to generate not only the FR speaker sound signal corresponding to the input FR sound signal but also the FC speaker sound signal and the FL speaker sound signal.

The mixing unit 57-1 mixes the FL speaker output sound signals from the fixed position long distance localization processing unit 54 and the fixed position short distance localization processing unit 56 and outputs the mixed FL speaker output sound signal to the mixing unit 23. The mixing unit 57-2 mixes the FC speaker output sound signals from the fixed position long distance localization processing unit 54 and the fixed position short distance localization processing unit 56 and outputs the mixed FC speaker output sound signal to the mixing unit 23.

The mixing unit 57-3 mixes the FR speaker output sound signals from the fixed position long distance localization processing unit 54, the real audio source localization processing unit 55, and the fixed position short distance localization processing unit 56 and outputs the mixed FR speaker output sound signal to the mixing unit 23.

In the exemplary configuration of the depth control processing units 22-1 and 22-2 shown in FIG. 1, the output destination of the sound signal from the real audio source position localization processing unit 55 is substituted by the mixing unit mixing the corresponding channel speaker output sound signal among the mixing units 57-1 to 57-3. That is, the other configuration is basically the same as the exemplary configuration of the depth control processing unit 22-3 show in FIG. 2. Hereinafter, the configuration of the depth control processing unit 22-3 shown in FIG. 2 will be used as the configurations of the depth control processing units 22-1 and 22-2.

Description of Signal Processing

Figure 3:
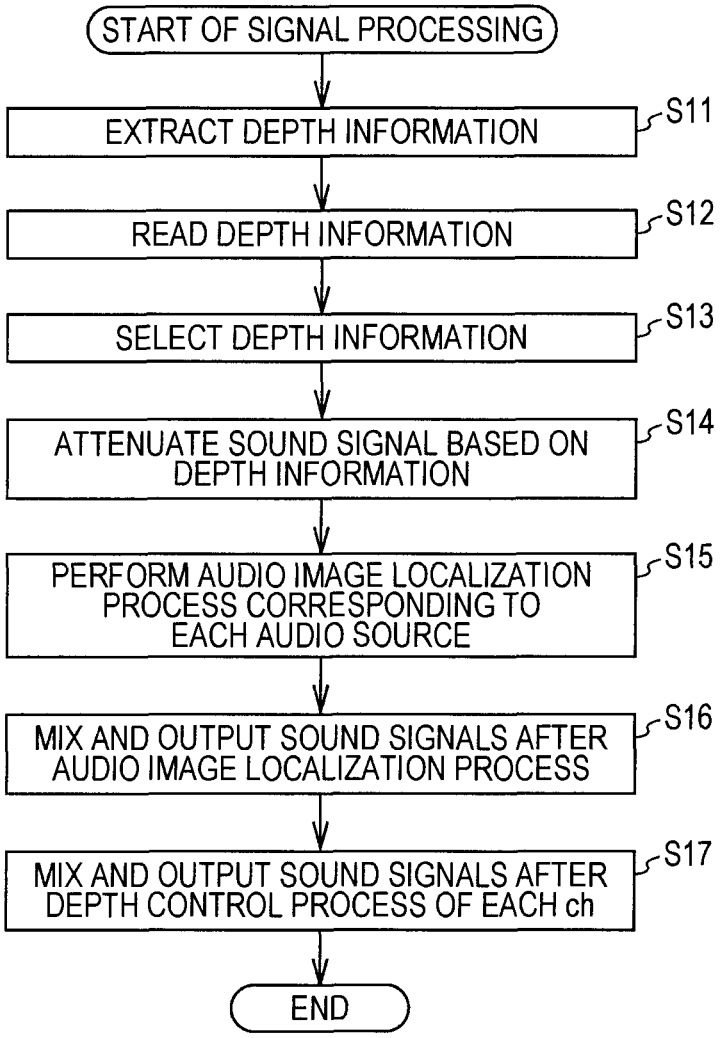
FIG. 3 is a flowchart illustrating signal processing of the signal processing apparatus shown in FIG. 1.

Next, the signal processing of the signal processing apparatus 11 shown in FIG. 1 will be described with reference to the flowchart of FIG. 3.

The FLch, FCch, FRch sound signals from the front stage (not shown) are input to the depth information extraction unit 21 and the attenuators 53-1 to 53-3 of the depth control processing units 22-1 to 22-3, respectively.

In step S11, the depth information extraction unit 21 extracts the respective FLch, FCch, and FRch depth information multiplexed in advance by a content producer from the FLch, FCch, and FRch sound signals, respectively. The depth information extraction unit 21 supplies the depth information to the depth information selection unit 52 of the corresponding depth control processing units 22-1 to 22-3.

In step S12 to step S16, the depth control processing units 22-1 to 22-3 perform signal processing. Therefore, the depth control processing unit 22-3 (FR signal processing) will be described as a representative example.

In step S12, the depth information storage unit 51 of the depth control processing unit 22-3 reads the stored depth information regarding each audio source position and supplies the read depth information to the depth information selection unit 52.

In step S13, the depth information selection unit 52 selects one of the depth information regarding each audio source position from the depth information extraction unit 21 and the depth information stored in advance. The depth information selection unit 52 supplies the selected depth information to the corresponding attenuators 53-1 to 53-3.

In step S14, the attenuators 53-1 to 53-3 attenuate the input FR sound signal based on the depth information from the depth information selection unit 52. The attenuator 53-1 outputs the attenuated sound signal to the fixed position long distance localization processing unit 54. The attenuator 53-2 outputs the attenuated sound signal to the real audio source position localization processing unit 55. The attenuator 53-3 outputs the attenuated sound signal to the fixed position short distance localization processing unit 56.

In step S15, the fixed position long distance localization processing unit 54, the real audio source position localization processing unit 55, the fixed position short distance localization processing unit 56 each perform audio image localization processing corresponding to each audio source position.

Specifically, the fixed position long distance localization processing unit 54 performs signal processing to form the FR long distance localization virtual audio source 31-3. The fixed position long distance localization processing unit 54 outputs the processed FL speaker output sound signal to the mixing unit 57-1, outputs the processed FC speaker output sound signal to the mixing unit 57-2, and outputs the processed FR speaker output sound signal to the mixing unit 57-3.

The real audio source position localization processing unit 55 performs signal processing to form the real audio source which is the reproduction speaker 24-3. The real audio source position localization processing unit 55 outputs the processed FR speaker output sound signal to the mixing unit 57-3.

The fixed position short distance localization processing unit 56 performs signal processing to form the FR short distance localization virtual audio source 32-3. The fixed position short distance localization processing unit 56 outputs the processed FL speaker output sound signal to the mixing unit 57-1, outputs the processed FC speaker output sound signal to the mixing unit 57-2, and outputs the processed FR speaker output sound signal to the mixing unit 57-3.

In step S16, the mixing units 57-1 to 57-3 mix the sound signals, which have been subjected to the audio image localization processing and supplied from at least one of the fixed position long distance localization processing unit 54, the real audio source position localization processing unit 55, the fixed position short distance localization processing unit 56, and output the mixed sound signal to the mixing unit 23.

That is, the mixing unit 57-1 mixes the FL speaker output sound signals from the fixed position long distance localization processing unit 54 and the fixed position short distance localization processing unit 56, and then outputs the mixed FL speaker output sound signal to the mixing unit 23. The mixing unit 57-2 mixes the FC speaker output sound signals from the fixed position long distance localization processing unit 54 and the fixed position short distance localization processing unit 56, and then outputs the mixed FC speaker output sound signal to the mixing unit 23.

The mixing unit 57-3 mixes the FR speaker output sound signals from the fixed position long distance localization processing unit 54, the real audio source position localization processing unit 55, and the fixed position short distance localization processing unit 56, and then outputs the mixed FR speaker output sound signal to the mixing unit 23.

In step S17, the mixing unit 23 mixes the respective speaker output sound signals, which have been subjected to the depth control processing and supplied from the respective depth control processing units 22-1 to 22-3, for each speaker. The mixing unit 23 outputs the mixed speaker output sound signals to the corresponding reproduction speakers 24-1 to 24-3, respectively.

The reproduction speaker 24-1 outputs a sound corresponding to the FL speaker output sound signal from the mixing unit 23. The reproduction speaker 24-2 outputs a sound corresponding to the FC speaker output sound signal from the mixing unit 23. The reproduction speaker 24-3 outputs a sound corresponding to the FR speaker output sound signal from the mixing unit 23.

Thus, in the case of FLch, by giving the predetermined level balance between the three audio sources: the real audio source which is the reproduction speaker 24-1, the FL long distance localization virtual audio source 31-1, and the FL short distance localization virtual audio source 32-1, the synthesized audio image 33-1 is formed between these audio sources. In the case of FCch, by giving the predetermined level balance between the three audio sources: the real audio source which is the reproduction speaker 24-2, the FC long distance localization virtual audio source 31-2, and the FC short distance localization virtual audio source 32-2, the synthesized audio image 33-2 is formed between these audio sources. In the case of FRch, by giving the predetermined level balance between the three audio sources: the real audio source which is the reproduction speaker 24-3, the FR long distance localization virtual audio source 31-3, and the FR short distance localization virtual audio source 32-3, the synthesized audio image 33-3 is formed between these audio sources.

As described above, by acquiring the depth information corresponding to each channel and controlling the positions of the audio sources based on the depth information, a sense of a sound field can be provided according to the sense of depth of a stereoscopic image or the intention of a content producer.

As described above, the signal processing apparatus 11 includes the depth information extraction unit 21, the depth information storage unit 51, and the depth information selection 52. However, only the depth information extraction unit 21 or the depth information storage unit 51 may be provided. In this case, since it is not necessary to provide the depth information selection unit 52, the depth information selection unit 52 may be excluded.

Exemplary Configuration of Depth Control Processing Unit

Figure 4:
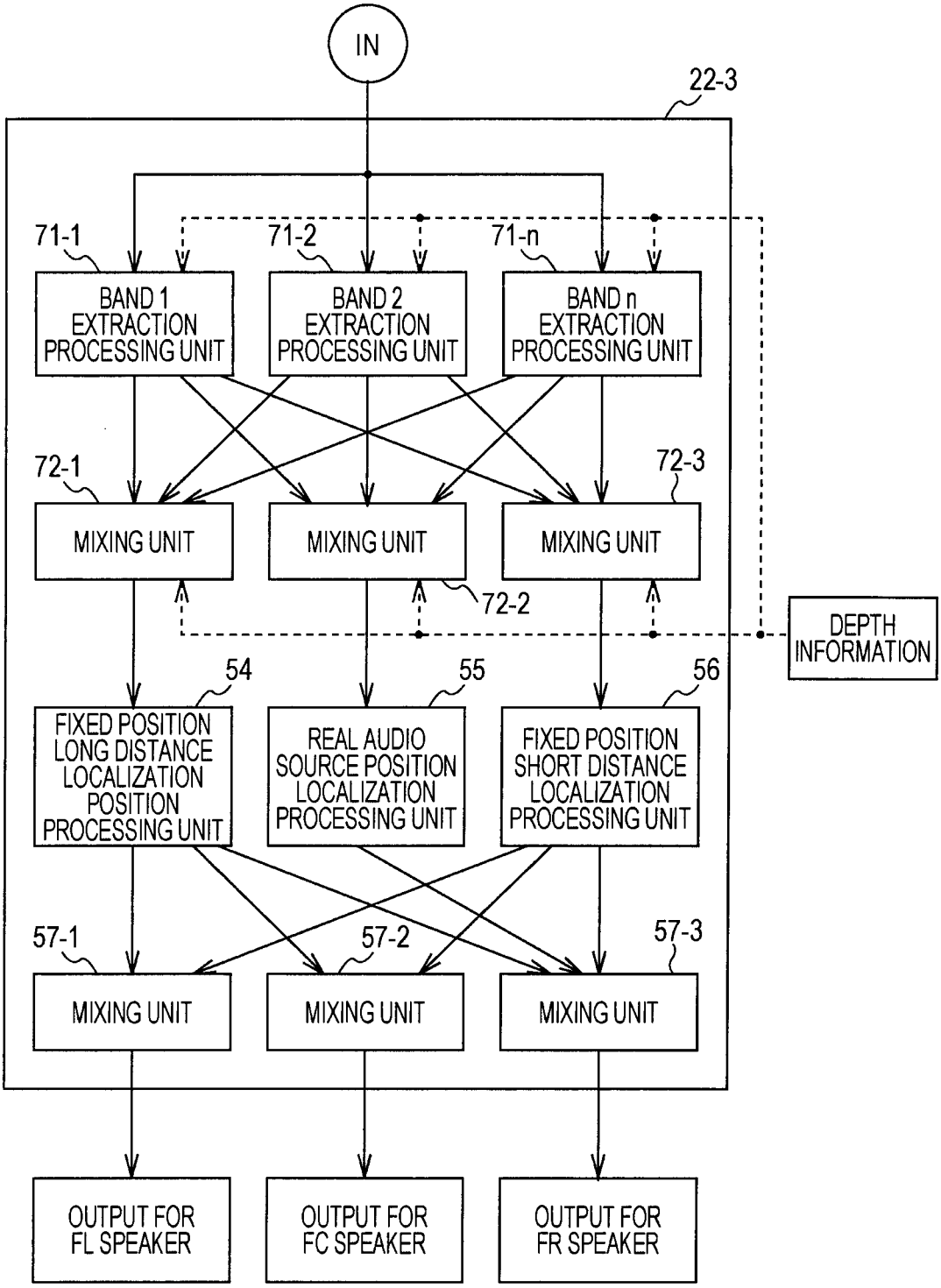
FIG. 4 is a block diagram illustrating another exemplary configuration of the depth control processing unit.

FIG. 4 is a block diagram illustrating another exemplary configuration of the depth control processing unit 22-3 performing the depth control processing on the FRch sound signal.

The depth control processing unit 22-3 in FIG. 4 is different from the depth control processing unit 22-3 in FIG. 2 in that the depth information storage unit 51, the depth information selection unit 52, and the attenuators 53-1 to 53-3 are excluded. Moreover, the depth control processing unit 22-3 in FIG. 4 is different from the depth control processing unit 22-3 in FIG. 2 in that a band 1 extraction processing unit 71-1, a band 2 extraction processing unit 71-2, . . . , and a band n extraction processing unit **71-*n*, and mixing units 72-1 to 72-3** are added.

The depth control processing unit 22-3 in FIG. 4 is the same as the depth control processing unit 22-3 in FIG. 2 in that the fixed position long distance localization processing unit 54, the real audio source position localization processing unit 55, the fixed position short distance localization processing unit 56, and the mixing units 57-1 to 57-3 are provided.

The corresponding FRch depth information from the depth information extraction unit 21 are supplied to the band 1 extraction processing unit 71-1, the band 2 extraction processing unit 71-2, . . . , and the band n extraction processing unit **71-*n* and the mixing units 72-1 to 72-3**. For example, the depth information includes control band information such as the number of segmented bands and each band range and a mixing ratio which is a weight of each band for each audio source position.

The band 1 extraction processing unit 71-1 extracts a band 1 signal from the input sound signal based on the depth information and supplies the extracted band 1 sound signal to the mixing units 72-1 to 72-3. Moreover, the band 2 extraction processing unit 71-2 extracts a band 2 signal from the input sound signal based on the depth information and supplies the extracted band 2 sound signal to the mixing units 72-1 to 72-3. Likewise, the band 3 extraction processing unit 71-3 to the band n extraction processing unit **71-*n* extract a band 3 signal to a band n signal from the input sound signal based on the depth information and supply the extracted band 3 sound signal to the band n sound signal to the mixing units 72-1 to 72-3, respectively. That is, in the example of FIG. 4, the band of the sound signal is segmented into a band 1 to a band n and the n bands are extracted by the n band extraction processing units 71**, respectively. Here, a relation of $n \leq 1$ is satisfied.

The mixing unit 72-1 multiplies the sound signal of each band by a mixing ratio corresponding to a long distance audio source position of a band corresponding to the depth information, mixes the sound signals, and outputs the mixed sound signal to the fixed position long distance localization processing unit 54.

The mixing unit 72-2 multiplies the sound signal of each band by a mixing ratio corresponding to a real audio source position of a band corresponding to the depth information, mixes the sound signals, and outputs the mixed sound signal to the real audio source position localization processing unit 55.

The mixing unit 72-3 multiplies the sound signal of each band by a mixing ratio corresponding to a short distance audio source position of a band corresponding to the depth information, mixes the sound signals, and outputs the mixed sound signal to the fixed position short distance localization processing unit 56.

In the exemplary configuration of the depth control processing units 22-1 and 22-2, the output destination of the sound signal from the real audio source position localization processing unit 55 is substituted by the mixing unit mixing the corresponding channel speaker output sound signal among the mixing units 57-1 to 57-3. That is, the other configuration is basically the same as the exemplary configuration of the depth control processing unit 22-3 shown in FIG. 4. Hereinafter, the configuration of the depth control processing unit 22-3 shown in FIG. 4 will be used as the configurations of the depth control processing units 22-1 and 22-2.

Example of Depth Information

FIG. 5 is a diagram illustrating an example of the FRch depth information. The depth information shown in FIG. 5 describes a mixing ratio w which is a weight for each audio source position of each frequency band.

For example, the depth information describes that the mixing ratio w of the long distance virtual audio source position of a frequency band 1 is 0.5, the mixing ratio w of the real audio source position thereof is 0.2, and the mixing ratio w of the short distance virtual audio source position thereof is 0.3. Moreover, the depth information describes that the mixing ratio w of the real audio source position of a frequency band 2 is 0, the mixing ratio w of the long distance virtual audio source position thereof is 1, and the mixing ratio w of the short distance virtual audio source position thereof is 0. Furthermore, the depth information describes that the mixing ratio w of the long distance virtual audio source position of a frequency band n is 0.3, the mixing ratio w of the real audio source position thereof is 0.5, and the mixing ratio w of the short distance virtual audio source position thereof is 0.2. Examples of the mixing ratios of a frequency band 3 to a frequency band n−1 are omitted.

Although not shown in the example of FIG. 5, the depth information also describes control band information such as the number of segmented bands and each band range.

Description of Signal Processing

Figure 6:
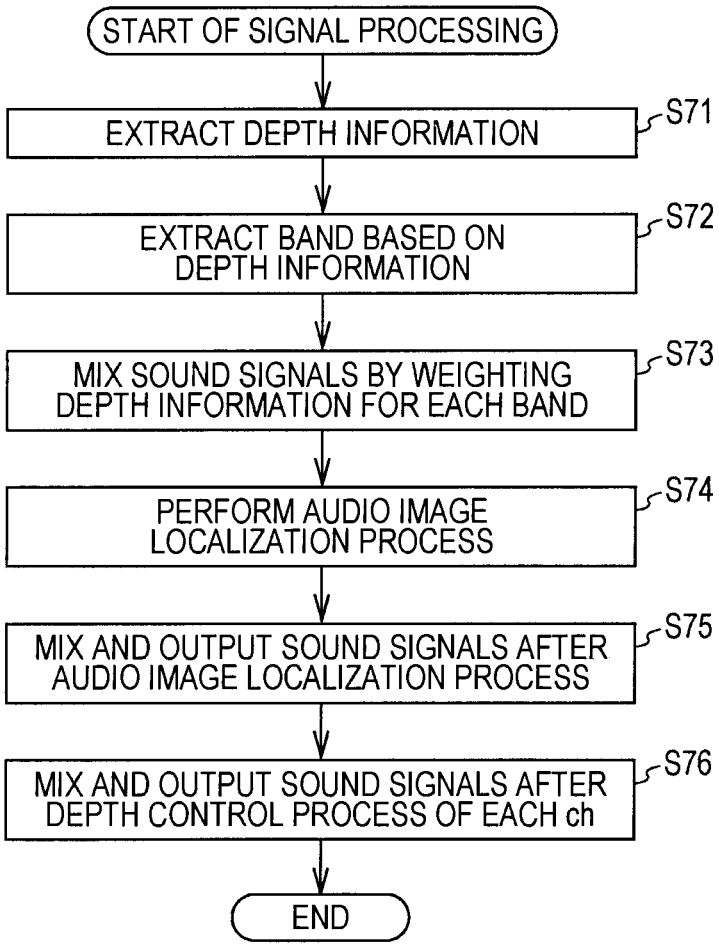
FIG. 6 is a flowchart illustrating the signal processing of the signal processing apparatus shown in FIG. 1 in the depth control processing unit shown in FIG. 4.

Next, the signal processing of the signal processing apparatus 11 shown in FIG. 1 in the depth control processing unit 22-3 shown in FIG. 4 will be described with reference to the flowchart of FIG. 6.

The FLch, FCch, FRch sound signals from the front stage (not shown) are input to the depth information extraction unit 21 and the band 1 extraction processing unit 71-1, the band 2 extraction processing unit 71-2, . . . , and the band n extraction processing unit **71-*n* of the depth control processing units 22-1 to 22-3**, respectively.

In step S71, the depth information extraction unit 21 extracts the respective FLch, FCch, and FRch depth information multiplexed in advance by a content producer from the FLch, FCch, and FRch sound signals, respectively. The depth information extraction unit 21 supplies the band 1 extraction processing unit 71-1, the band 2 extraction processing unit 71-2, . . . , and the band n extraction processing unit **71-*n* of the depth control processing units 22-1 to 22-3 and the mixing units 72-1 to 72-3**.

In step S72 to step S75, the depth control processing units 22-1 to 22-3 perform signal processing. Therefore, the depth control processing unit 22-3 (FR signal processing) will be described as a representative example.

In step S72, the band 1 extraction processing unit 71-1, the band 2 extraction processing unit 71-2, . . . , and the band n extraction processing unit **71-*n* extract the corresponding bands from the input sound signals, respectively, based on the control band information such as the number of segmented bands and each band range of the depth information. The band 1 extraction processing unit 71-1, the band 2 extraction processing unit 71-2, . . . , and the band n extraction processing unit 71-*n* each output the sound signals of the extracted bands to the mixing units 72-1 to 72-3**.

In step S73, the mixing units 72-1 to 72-3 mix the sound signals of the respective bands according to the weight in the depth information. That is, the mixing units 72-1 to 72-3 multiply the sound signal of each band by the mixing ratio corresponding to each audio source position of a band corresponding to the depth information, mix the sound signals, and output the mixed sound signal to the corresponding localization processing units 54 to 56, respectively.

Specifically, the mixing unit 72-1 multiplies the sound signal of each band by the mixing ratio corresponding to the long distance audio source position of the band corresponding to the depth information, mixes the sound signals, and outputs the mixed sound signal to the fixed position long distance localization processing unit 54. The mixing unit 72-2 multiplies the sound signal of each band by the mixing ratio corresponding to the real audio source position of the band corresponding to the depth information, mixes the sound signals, and outputs the mixed sound signal to the real audio source position localization processing unit 55. The mixing unit 72-3 multiplies the sound signal of each band by the mixing ratio corresponding to the short distance audio source position of the band corresponding to the depth information, mixes the sound signals, and outputs the mixed sound signal to the fixed position short distance localization processing unit 56.

In step S74, the fixed position long distance localization processing unit 54, the real audio source position localization processing unit 55, and the fixed position short distance localization processing unit 56 each perform audio image localization processing corresponding to each audio source position.

In step S75, the mixing units 57-1 to 57-3 mix the sound signals, which have been subjected to the audio image localization processing and supplied from at least one of the fixed position long distance localization processing unit 54, the real audio source position localization processing unit 55, and the fixed position short distance localization processing unit 56, and output the mixed sound signal to the mixing unit 23.

In step S76, the mixing unit 23 mixes the respective speaker output sound signals, which have been subjected to the depth control processing and supplied from the respective depth control processing units 22-1 to 22-3, for each speaker. The mixing unit 23 outputs the mixed speaker output sound signals to the corresponding reproduction speakers 24-1 to 24-3, respectively.

Since the above-described processes of step S74 to step S76 are basically the same as those of step S15 to S17 described with reference to FIG. 3, the description of the specific processes will not be repeated.

Thus, in the example of FIG. 4, the bands are independently subjected to the depth control by further segmenting the input sound signal for each band.

Thus, for example, when a voice (words) of a person and a background sound are mixed with the FCch sound signal, a method is used in which the band of the voice of the person is localized in the real audio source, the other bands are localized in the short distance or long distance. Of source, even when the band is segmented, sound materials other than a target sound material normally overlap with each other.

Therefore, it is necessary to select and designate the main band of the target sound material.

The control band information is included in the depth information, as described above. The control band and the audio image position may be changed sequentially. Alternatively, the control band may be fixed and, for example, the audio image position of only the band other than the band of the voice of a person may be changed. In the latter case, it is not necessary for the depth information to include the control band information.

The depth position may be fixed according to the main band of an input signal without using the depth information. Moreover, for example, the main band of an input signal may be fixed to the voice of a person and the depth information may be fixed.

Exemplary Configuration of Signal Processing Apparatus

Figure 7:
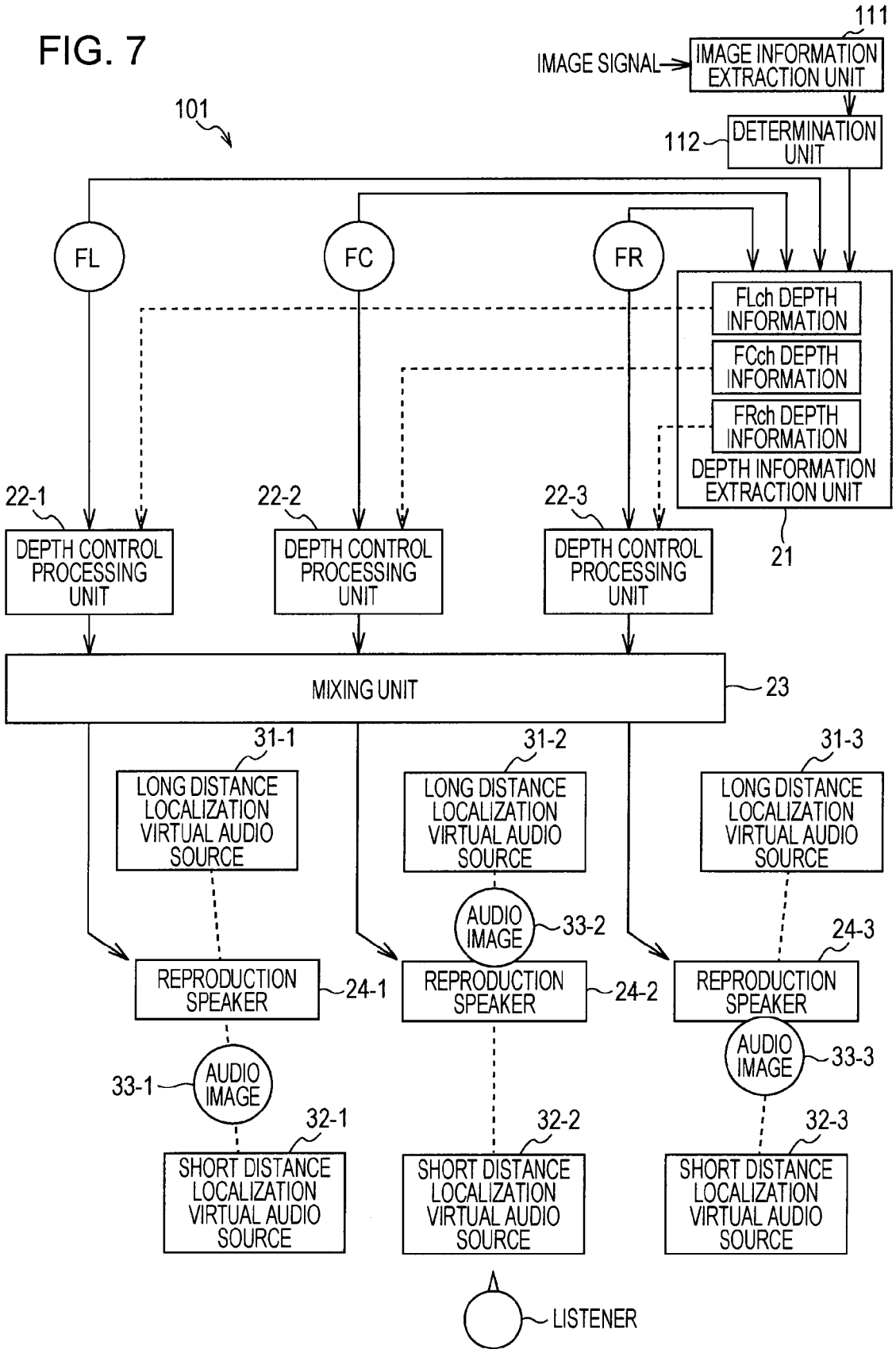
FIG. 7 is a block diagram illustrating the configuration of a signal processing apparatus according to a second embodiment of the invention.

FIG. 7 is a diagram illustrating the configuration of a signal processing apparatus according to a second embodiment of the invention. A signal processing apparatus 101 shown in FIG. 7 is the same as the signal processing apparatus 11 shown in FIG. 1 in that the depth information extraction unit 21, the depth control processing units 22-1 to 22-3, the mixing (Mix) unit 23, and the reproduction speakers 24-1 to 24-3 are included. In the signal processing apparatus 101 shown in FIG. 7, the audio image synthesizing method is used as in the signal processing apparatus 11 shown in FIG. 1.

On the other hand, the signal processing apparatus 101 shown in FIG. 7 is different from the signal processing apparatus 11 shown in FIG. 1 in that an image information extraction unit 111 and a determination unit 112 are added. That is, an image signal corresponding to the sound signal input to the depth control processing units 22-1 to 22-3 is input to the image information extraction unit 111.

The image information extraction unit 111 extracts the depth information by analyzing parallax information indicating where the information is present at the positions corresponding to FL, FC, and FR, and whether information is projected beforehand or in the rear side, for stereoscopic information of the image signal. The image information extraction unit 111 supplies the extracted depth information to the determination unit 112.

The determination unit 112 compares the depth information from the image information extraction unit 111 to the depth information extracted from the sound signal by the depth information extraction unit 21. When both the depth information match each other (when there is considerably no difference), the depth information from the image information extraction unit 111 is supplied to the depth information extraction unit 21.

When the depth information is supplied from the determination unit 112, the depth information extraction unit 21 supplies this depth information together with the extracted depth information to the depth control processing units 22-1 to 22-3. That is, in this case, the depth information from the image signal is used as auxiliary information.

In the example of FIG. 7, the determination unit 112 is provided. However, the determination unit 112 may not be provided. In this case, the depth information extraction unit 21 may use the depth information extracted from the sound signal or may use the depth information extracted from the image signal. The determination may be made according to a setting of a user. Moreover, when the depth information is not extracted from the sound signal, the depth information extracted from the image signal may be used.

The determination unit 112 may determine and use the depth information with high accuracy between the depth information extracted from the sound signal and the depth information extracted from the image signal.

As described above, in the audio image synthesizing method, the short distance localization virtual audio source and the long distance localization virtual audio source are formed in addition to the real audio source position. However, only the short distance localization virtual audio source may be formed or only the long distance localization virtual audio source may be formed.

In this case, the depth information close to the localization position is processed. That is, for example, when only the short distance localization virtual audio source is formed in addition to the real audio source position, the localization process includes the real audio source position localization process and the short distance localization process. However, when only the long distance localization virtual audio source is designated as the depth information, the real audio source position is designated for the processing.

The above-described depth information provides the depth information of each ch. As described above, each channel of the FL, FR, and FC among 5.1 ch (channel) is the target for the depth control, but the invention is not limited thereto. For example, in a case of general 5.1 ch (FL/FR/FC/SL/SR/SW), the depth information for each channel of FL/FR/FC/SL/SR/SW may be the target for the depth control.

However, this depth information may not necessarily be provided for every ch. For example, as described above with reference to FIG. 7, when the depth information of the audio source is extracted from the stereoscopic information of an image, the depth information is provided for only channel included in the position (front side) at which there is the image information. Therefore, in this case, the depth information for each channel of FL, FR, and FC is provided among 5.1 ch.

Thus, the signal processing can be simply performed by providing the depth information for each ch. Normally, various sounds are already mixed in the 5.1 ch signal of a sound according to the related art. Therefore, only the depth information regarding channel can be configured reasonably as long as large-scale processing such as audio source separation is not performed.

As described above, the signal processing unit performing the sound depth control can fix the sound to each ch. Therefore, for example, the advantage of easily estimating a signal processing resource can be obtained in terms of practical use.

In the embodiments of the invention, since the depth control processing can be performed on the signal of each channel using the depth information regarding each ch, the audio image position of each channel can be changed.

Therefore, a sense of a sound field can be simply provided according to a sense of depth of a video. Moreover, a sense of a sound field can be provided according to the intention of a content producer.

As described above, the audio image synthesizing method has been used as an example, but the embodiments of the invention are applicable to other audio image methods. For example, a so-called an HRTF (Head-Related Transfer Function) method of changing HRTF according to an audio image position may be used.

In the case of the HRTF method, distance information regarding the audio image localization is given as the depth information instead of the mixing ratio or the attenuation amount of the audio image synthesizing method. In the case of the HRTF method, since a database is included, a coefficient is decided from the database according to a distance, the coefficient is changed, and the audio image localization processing is performed.

Accordingly, the audio image synthesizing method has an advantage in that it is not necessary to provide the database compared to the HRTF method. In the case of the HRTF method, a problem may arise in that a sound may be interrupted due to the switching timing of the coefficient. However, the audio image synthesizing method has an advantage in that this problem does not occur.

The above-described series of processes may be executed by hardware or software. When the series of processes is executed by software, a program implementing the software is installed in a computer. The computer includes a computer embedded with dedicated hardware and a general personal computer capable of realizing various functions by installing various programs.

Exemplary Configuration of Personal Computer

Figure 8:
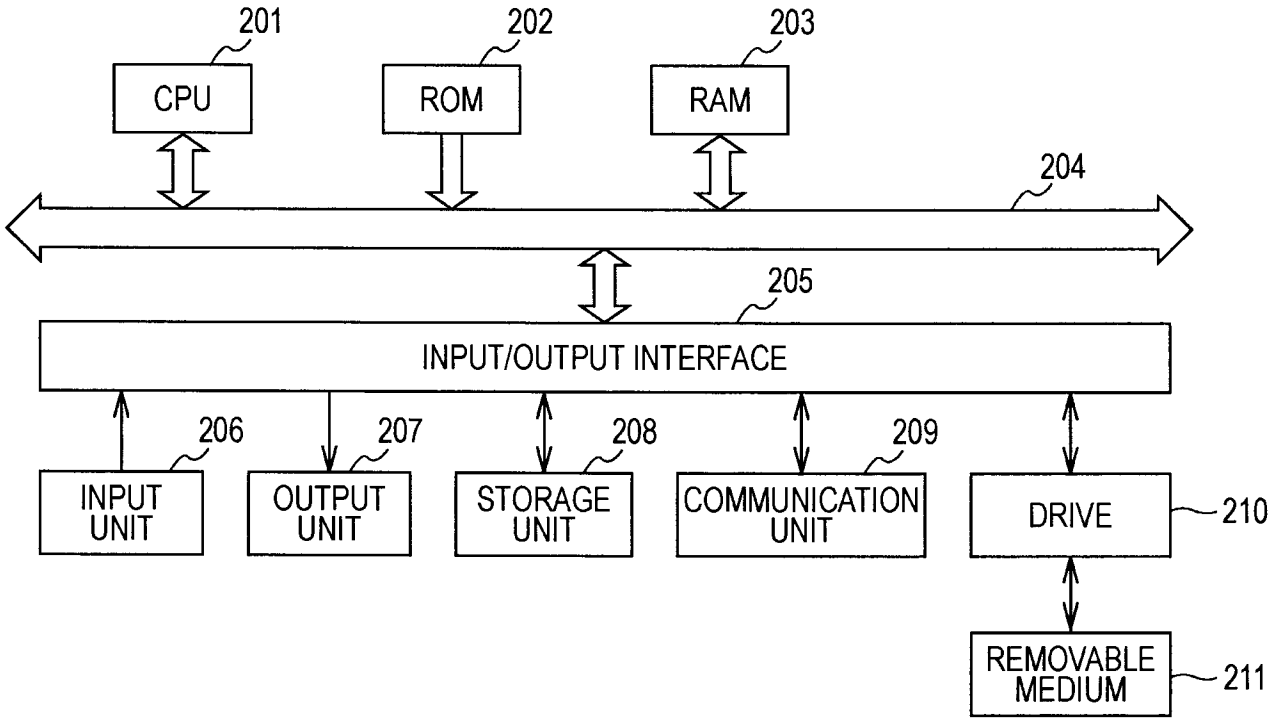
FIG. 8 is a block diagram illustrating an exemplary hardware configuration of a computer.

FIG. 8 is a diagram illustrating an exemplary hardware configuration of a computer executing the above-described series of processes according to a program.

In the computer, a CPU (Central Processing Unit) 201, a ROM (Read Only Memory) 202, and a RAM (Random Access Memory) 203 are connected to each other through a bus 204.

An input/output interface 205 is connected to the bus 204. An input unit 206, an output unit 207, a storage unit 208, a communication unit 209, and a drive 210 are connected to the input/output interface 205.

The input unit 206 is formed by a keyboard, a mouse, a microphone, or the like. The output unit 207 is formed by a display, a speaker, or the like. The storage unit 208 is formed by a hard disc, a non-volatile memory, or the like. The communication unit 209 is formed by a network interface or the like. The drive 210 drives a removable medium 211 such as a magnetic disc, an optical disc, a magneto-optical disc, or a semiconductor memory.

In the computer with such a configuration, the CPU 201 loads and executes, for example, a program stored in the storage unit 208 via the input/output interface 205 and the bus 204 on the RAM 203 to perform the above-described series of processes.

The program executed by the computer (CPU 201) can be provided in a recorded form for the removable medium 211 such as a package medium. Moreover, the program can be provided through a wired or wireless transmission medium such as a local network area, the Internet, or a digital broadcast.

In the computer, the program can be installed in the storage unit 208 by mounting the removable medium 211 on the drive 210 via the input/output interface 205. Moreover, the program can be received by the communication unit 209 via a wired or wireless transmission medium to be installed in the storage unit 208. Furthermore, the program can be installed in advance in the ROM 202 or the storage unit 208.

The program executed by the computer may be executed in the sequence described in the specification chronologically, may be executed in parallel, or may be executed at a necessary timing, for example, when the program is called.

The present application contains subject matter related to that disclosed in Japanese Priority Patent Application JP 2010-080517 filed in the Japan Patent Office on Mar. 31, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing apparatus, comprising:

one or more processors operable to:

extract information regarding each audio source position that is used to determine an audio image localization position of each frequency band, wherein the information is multiplexed in a plurality of sound signals;

perform audio image localization on each sound signal of the plurality of sound signals of each frequency band for each channel of the sound signal corresponding to each of the audio source position based on the extracted information, wherein the information comprises control band information including number of segmented frequency bands, each frequency band range and a mixing ratio;

mix the plurality of sound signals of the respective channels subjected to the audio image localization; and calculate a synthesized audio image for each channel based on one of a finite plurality of determined level balances between a real-audio source, a long-distance localization virtual audio source, and a short-distance localization virtual audio source.

2. The signal processing apparatus according to claim 1, wherein the information used to determine the audio image localization position is information regarding a weight of a determined position for audio image localization.

3. The signal processing apparatus according to claim 2, wherein the one or more processors are further operable to:

store the information used to determine the audio image localization position for each frequency band, wherein the audio image localization is performed on each of the sound signal of each frequency band for each channel of the sound signal based on the stored information used to determine the audio image localization position of each frequency band.

4. The signal processing apparatus according to claim 2, wherein the one or more processors are further operable to perform the audio image localization on each of the sound signal of each frequency band for each channel of the sound signal based on the extracted information used to determine the audio image localization position of each frequency band.

5. The signal processing apparatus according to claim 2, wherein the one or more processors are further operable to:

analyze the information used to determine the audio image localization position of each frequency band from parallax information in an image signal corresponding to each of the sound signal, wherein the audio image localization is performed on each of the sound signal of each frequency band for each channel of the sound signal based on the analyzed information used to determine the audio image localization position of each frequency band.

6. A signal processing method, comprising the steps of:

extracting information regarding each audio source position that is used to determine an audio image localization position of each frequency band, the information being multiplexed in a plurality of sound signals;

performing audio image localization processing on each sound signal of the plurality of sound signals of each frequency band for each channel of the sound signal corresponding to each of the audio source position based on the extracted information, wherein the information comprises control band information including number of segmented frequency bands, each frequency band range and a mixing ratio;

mixing the plurality of sound signals of the respective channels subjected to the audio image localization processing; and calculating a synthesized audio image for each channel based on one of a finite plurality of determined level balances between a real-audio source, a long distance localization virtual audio source, and a short-distance localization virtual audio source.

7. A non-transitory, computer-readable medium having stored thereon, computer-executable instructions for causing a computer to execute operations, the operations comprising:

extracting information regarding each audio source position that is used to determine an audio image localization position of each frequency band, the information being multiplexed in a plurality of sound signals;

performing audio image localization processing on each sound signal of the plurality of sound signals of each frequency band for each channel of the sound signal corresponding to each of the audio source position based on the extracted information, wherein the information comprises control band information including number of segmented frequency bands, each frequency band range and a mixing ratio;

mixing the plurality of sound signals of the respective channels subjected to the audio image localization processing; and calculating a synthesized audio image for each channel based on one of a finite plurality of predetermined level balances between a real-audio source, a long distance localization virtual audio source, and a short-distance localization virtual audio source.

8. A signal processing apparatus, comprising:

an extraction unit configured to extract information regarding each audio source position that is used to determine an audio image localization position of each frequency band, wherein the information is multiplexed in a plurality of sound signals;

an audio image localization processing unit configured to perform audio image localization on each sound signal of the plurality of sound signals each frequency band for each channel of the sound signal corresponding to each of the audio source position based on the extracted information, wherein the information comprises control band information including number of segmented frequency bands, each frequency band range and a mixing ratio;

a mixing unit configured to mix the plurality of sound signals of the respective channels subjected to the audio image localization by the audio image localization processing unit; and a calculation unit configured to calculate a synthesized audio image for each channel based on one of a finite plurality of determined level balances between a real-audio source, a long-distance localization virtual audio source, and a short-distance localization virtual audio source.

* * * * *